US009254658B2

(12) United States Patent
Yamada et al.

(10) Patent No.: US 9,254,658 B2
(45) Date of Patent: Feb. 9, 2016

(54) LIQUID EJECTION HEAD AND LIQUID EJECTION APPARATUS

(71) Applicant: CANON KABUSHIKI KAISHA, Tokyo (JP)

(72) Inventors: Kazuhiro Yamada, Yokohama (JP); Shuzo Iwanaga, Kawasaki (JP); Ryohei Goto, Fujisawa (JP); Takatsugu Moriya, Tokyo (JP); Zentaro Tamenaga, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/397,938

(22) PCT Filed: May 31, 2013

(86) PCT No.: PCT/JP2013/065761

§ 371 (c)(1),
(2) Date: Oct. 30, 2014

(87) PCT Pub. No.: WO2013/191009

PCT Pub. Date: Dec. 27, 2013

(65) Prior Publication Data

US 2015/0124025 A1 May 7, 2015

(30) Foreign Application Priority Data

Jun. 18, 2012 (JP) ..... 2012-136866
Apr. 5, 2013 (JP) ..... 2013-079508

(51) Int. Cl.
*B41J 2/05* (2006.01)
*B41J 2/14* (2006.01)
(Continued)

(52) U.S. Cl.
CPC ..... *B41J 2/14427* (2013.01); *B41J 2/155* (2013.01); *B41J 29/02* (2013.01); *B41J 2202/12* (2013.01); *B41J 2202/20* (2013.01)

(58) Field of Classification Search
None
See application file for complete search history.

(56) References Cited

U.S. PATENT DOCUMENTS 7,625,072 B2 12/2009 Saito et al.
8,177,330 B2 5/2012 Suganuma et al.
(Continued)

FOREIGN PATENT DOCUMENTS

CN 1417029 A 5/2003
CN 101797841 A 8/2010
(Continued)

OTHER PUBLICATIONS

International Preliminary Report on Patentability in International Application No. PCT/JP2013/065761, dated Dec. 23, 2014.
(Continued)

*Primary Examiner* — Matthew Luu
*Assistant Examiner* — Erica Lin
(74) *Attorney, Agent, or Firm* — Fitzpatrick, Cella, Harper & Scinto

(57) ABSTRACT

A liquid ejection head includes, a first support member including a flow path for supplying liquid and an opening communicating with the flow path; at least one second support member that includes an individual liquid chamber communicating with the opening and arranged on the first support member along the flow path; and a recording element substrate including an energy-generating element for generating energy for ejecting the liquid, and a supply port for supplying the liquid to the energy-generating element, the supply port communicating with the individual liquid chamber, the recording element substrate being supported by a back surface of the second support member with respect to an opposite surface thereof facing the first support member. When P (μJ/pL) represents energy to be input per ejection liquid droplet volume in the energy-generating element, thermal resistance R (K/W) of a shortest heat transfer path of the second support member between the recording element substrate and the first support member satisfies:

$$R \geq 1.4/ln\{0.525e^{1.004P}-0.372\}^{-1}.$$

16 Claims, 13 Drawing Sheets

(51) Int. Cl.
*B41J 2/155* (2006.01)
*B41J 29/02* (2006.01)

(56) References Cited

U.S. PATENT DOCUMENTS

| | | | | |
|---|---|---|---|---|
| 8,201,925 | B2 | 6/2012 | Saito et al. | |
| 8,287,103 | B2 | 10/2012 | Saito et al. | |
| 8,622,522 | B2 | 1/2014 | Saito et al. | |
| 2009/0051724 | A1 | 2/2009 | Katoh | |
| 2009/0141064 | A1 | 6/2009 | Shihoh et al. | |
| 2013/0293641 | A1* | 11/2013 | Essen et al. | 347/89 |
| 2015/0029265 | A1 | 1/2015 | Iwanaga et al. | |

FOREIGN PATENT DOCUMENTS

| | | | |
|---|---|---|---|
| JP | 7-195696 | A | 8/1995 |
| JP | 2008-055870 | A | 3/2008 |
| JP | 2009-045905 | A | 3/2009 |
| JP | 2009-137023 | A | 6/2009 |

OTHER PUBLICATIONS

Office Action in Chinese Patent Application No. 201380029981.6, dated Jul. 3, 2015.

* cited by examiner

LIQUID EJECTION HEAD AND LIQUID EJECTION APPARATUS

TECHNICAL FIELD

The present invention relates to a liquid ejection head to be preferably used in the fields of inkjet recording and the like, and a liquid ejection apparatus using the liquid ejection head.

BACKGROUND ART

In recent years, inkjet printers have been used not only for household printing applications but also for business printing applications for offices and retail photos or industrial applications such as electronic circuit drawing and flat panel display production, and thus, the applications of the inkjet printers are spreading. Of those, a head of an inkjet printer for business is required to have high-speed printing performance, and in order to meet the requirement, ink ejection is performed at a higher frequency. Alternatively, in order to realize high-speed printing, a full-line head is used in which the width of a recording head is matched with that of a recording medium, and ejection orifices in a larger number than that of the conventional ones are arranged. In general, the full-line head is configured in such a manner that multiple recording element substrates are arranged on a support member.

In general, as an ink ejection method for a liquid ejection head, there are a thermal system and a piezoelectric system. The thermal system involves boiling ink by applying heat thereto to utilize bubbling force caused thereby, and the piezoelectric system uses deforming force of a piezoelectric element. In the case of the thermal system, temperature changes due to the heat generated during ejection, which influences image quality. The reason for this is as follows. When the temperature of a head rises, the temperature of ink also rises. The ejection amount of ink changes in accordance with the rise in temperature of the ink, and as a result, the printing density in an initial stage of printing becomes different from that in a later stage. On the other hand, in the case of the piezoelectric system, a change in temperature of ink caused by an ejection operation is small. Therefore, the image quality is relatively less influenced by a change in temperature of ink. However, in the case of the piezoelectric system, in particular, in a system involving ejecting ink through use of shear deformation (shear mode) of a piezoelectric element, energy efficiency during ejection is low, and hence, a calorific value of a recording element substrate is large. Consequently, the temperature of ink is likely to rise, which easily influences image quality.

On the other hand, the full-line head is basically required to perform a continuous operation so as to take advantage of the high-speed printing performance. Therefore, in the case where a head is heated excessively, cooling time cannot be provided by suspending a printing operation, unlike a conventional serial head. In the case of performing high-speed printing by forming a full-line head through use of a thermal system or a piezoelectric system of a shear mode, the full-line head is likely to be heated excessively because a calorific value of a recording element substrate is large. As a result, the temperature of ink rises easily.

In view of the foregoing, it has been hitherto proposed to provide a cooling unit in a full-line head through use of forced convection. FIGS. 13A and 13B are schematic views each illustrating an example of a conventional full-line head structure. FIG. 13A is a perspective view of the full-line head, and FIG. 13B is a partial sectional view taken along line 13B-13B of FIG. 13A. As illustrated in FIG. 13B, a flow path 103 for supplying ink is formed in a support member 102. The flow path 103 is connected to an ink tank and a pump (not shown). Ink circulates to flow through a circulation path formed of the ink tank, the pump, and the flow path 103 during head driving. Part of the ink distributed in the flow path 103 is supplied to each recording element substrate 101, and the remaining ink circulates to be supplied to the flow path 103 again. Heat generated in each recording element substrate 101 is discharged to the ink passing through the support member 102. Therefore, a material such as alumina having high thermal conductivity is used for the support member 102.

However, in the configuration illustrated in FIGS. 13A and 13B, that is, a configuration in which the ink is allowed to circulate to be cooled, there is a problem in that the temperature of the ink rises more on the downstream side in the support member 102. The reason for this is that the heat which the ink receives from the recording element substrates 101 accumulates as the ink is distributed to the downstream side in the support member 102, and the total amount of the heat which the ink receives from the recording element substrates 101 increases more on the downstream side. Therefore, in the full-line head, there arises another problem in that density unevenness occurs in printed matter in a width direction of a recording medium. The same problem also occurs in a full-line head in which ink does not circulate. The reason for this is as follows. Even in the case where the flow path in the support member has a dead end, the ink is supplied to the recording element substrate on the downstream side during full-line head driving, and hence, a flow of ink which flows while rising in temperature from the upstream side to the downstream side is formed in the support member.

Patent Literature 1 proposes a head array unit (full-line head) in which a refrigerant fluid is allowed to flow in the head separately from ink so as to cool each recording element substrate. Heat transfer efficiency between the refrigerant fluid and each recording element substrate is set so as to increase from the upstream side to the downstream side of the refrigerant fluid. Thus, a rise in temperature of the recording element substrates on the downstream side of the refrigerant fluid is suppressed, and as a result, a rise in temperature of the ink on the downstream side is also suppressed.

Patent Literature 2 proposes a full-line head in which an insulation member is provided between a circulation flow path in a head and a support plate for recording element substrates. Multiple recording element substrates are mounted on a lower surface of the support plate, and the insulation member made of a plate-like member is adhered to an upper surface of the support plate. A rear surface of the insulation member is fixed to a tank in the head having the circulation flow path. A communication port for supplying ink from the circulation flow path to the recording element substrates is provided so as to pass through the insulation member and the support plate. Due to the presence of the insulation member, heat is prevented from transferring from the recording element substrates to the ink, and as a result, a rise in temperature of the ink on the downstream side is also suppressed.

In the head described in Patent Literature 1, the temperature of recording element substrates on the downstream side of a refrigerant rises as the printing speed becomes higher, and a temperature difference between the recording element substrates increases.

Further, concurrently, a heat discharge amount to the outside of the head increases, and a heat exchanger for cooling the refrigerant is enlarged. Therefore, cooling power as well as head driving power increase.

In the head described in Patent Literature 2, heat transfers between the recording element substrates due to the heat transfer in the support plate and the small thermal spreading resistance, and hence, the temperature of the recording element substrates in the vicinity of a center of the head rises and a temperature difference between the recording element substrates cannot be reduced sufficiently.

CITATION LIST

Patent Literature

PTL 1: Japanese Patent Application Laid-Open No. 2009-045905

PTL 2: Japanese Patent Application Laid-Open No. 2009-137023

SUMMARY OF INVENTION

Technical Problem

It is an object of the present invention to provide a liquid ejection head which can maintain high image quality by suppressing a temperature difference between recording element substrates even at a high printing speed and which suppresses heat discharge from the head. It is another object of the present invention to provide a liquid ejection apparatus which suppresses heat discharge from the head along with an increase in printing speed in a configuration in which ink in the head is allowed to circulate.

According to an exemplary embodiment of the present invention, there is provided a liquid ejection head, including:

a first support member including a flow path for supplying liquid and an opening communicating with the flow path;

at least one second support member including an individual liquid chamber communicating with the opening, the at least one second support member being arranged on the first support member along the flow path; and a recording element substrate including an energy-generating element for generating energy to be used for ejecting the liquid, and a supply port for supplying the liquid to the energy-generating element, the supply port communicating with the individual liquid chamber, the recording element substrate being supported by a back surface of the at least one second support member with respect to an opposite surface thereof facing the first support member, in which when energy to be input per ejection liquid droplet volume in the energy-generating element is defined as P (μJ/pL), a thermal resistance R (K/W) of a shortest heat transfer path of the at least one second support member between the recording element substrate and the first support member satisfies the following expression:

$$R \geq 1.4/\ln\{0.525e^{1.004P}-0.372\}^{-1}$$

Further features of the present invention will become apparent from the following description of exemplary embodiments with reference to the attached drawings.

DESCRIPTION OF EMBODIMENTS

Exemplary embodiments of the present invention are hereinafter described with reference to the drawings. Note that, the scope of the present invention is not limited to various shapes, arrangements, and the like described below. Similarly, although the embodiments are applied to a liquid ejection head using a thermal system, the embodiments are also applied to a liquid ejection head of a piezoelectric system using a shear mode.

Liquid Ejection Head Structure of First Embodiment

Figure 1:
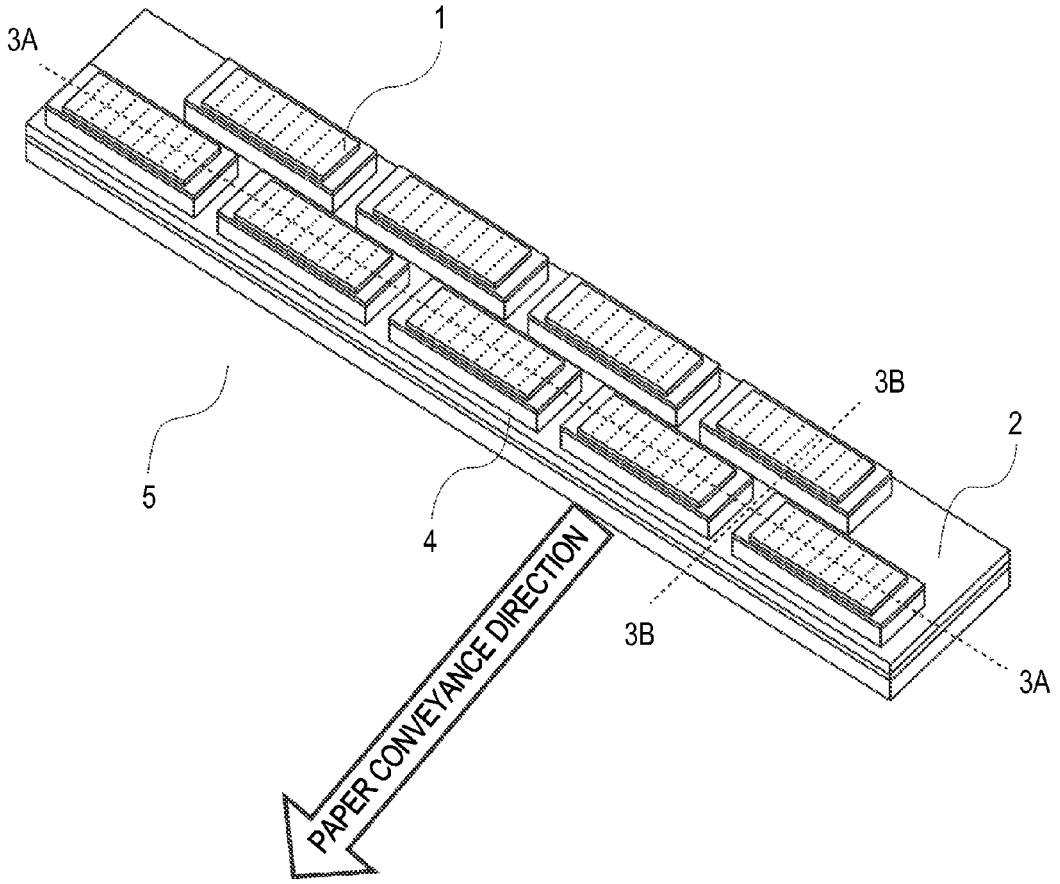
FIG. 1 is a schematic perspective view of a liquid ejection head according to a first embodiment of the present invention.
Figure 2:
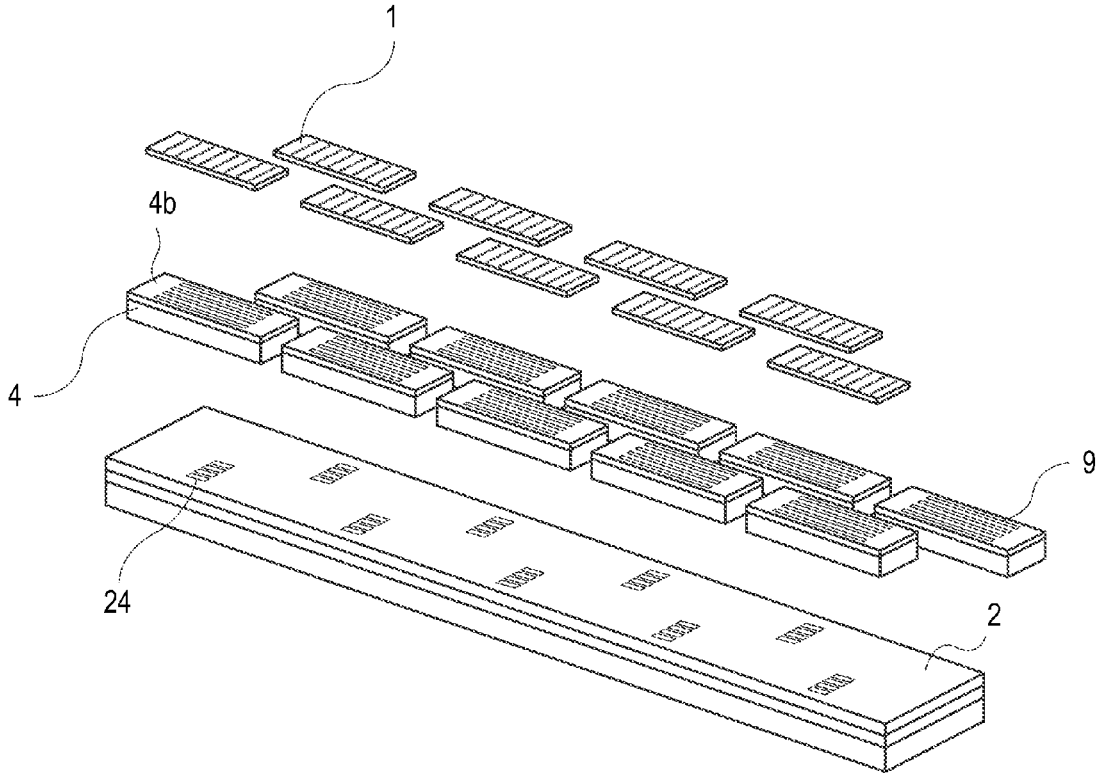
FIG. 2 is an exploded perspective view of the liquid ejection head of FIG. 1.
Figure 3A:
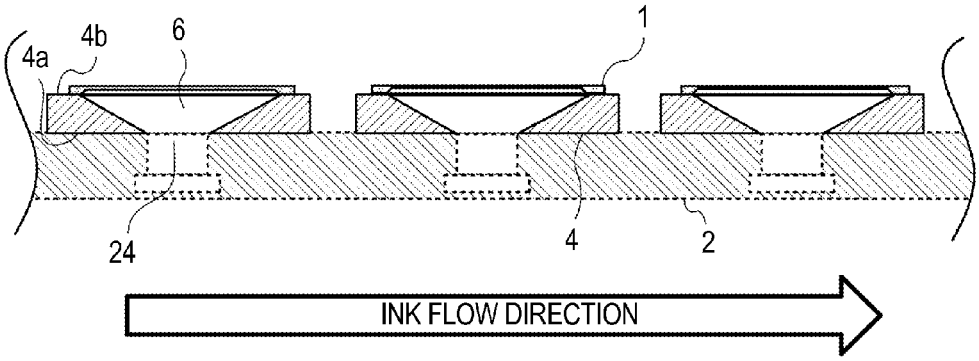
FIGS. 3A and 3B are sectional views of the liquid ejection head of FIG. 1.
Figure 3B:
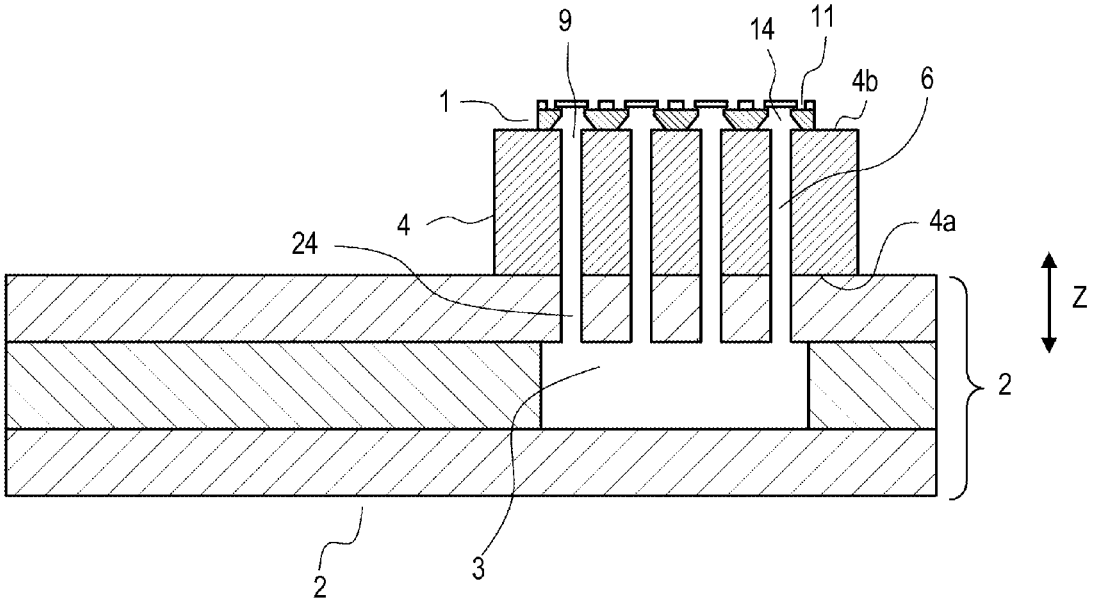

FIG. 1 illustrates a liquid ejection head 5 for ejecting liquid such as ink according to a first embodiment of the present invention. The liquid ejection head 5 illustrated in FIG. 1 is an exemplary configuration of a full-line head including recording element substrates 1 arranged in a staggered shape and having a width (length) corresponding to the width of a recording medium. FIG. 2 is an exploded perspective view of the full-line head of FIG. 1. FIG. 3A is a partial sectional view taken along line 3A-3A of FIG. 1, and FIG. 3B is a sectional view taken along line 3B-3B of FIG. 1.

As is understood from the figures, the liquid ejection head 5 includes a support member 2 (first support member), multiple insulation members 4 (second support members), and multiple recording element substrates 1. The insulation members 4 are arranged individually so as to correspond to the respective recording element substrates 1, and the respective insulation members 4 are arranged on the support member 2. The insulation member 4 is joined to the recording element substrate 1 and the support member 2 through intermediation of an adhesive (not shown) respectively on its both surfaces 4*a* and 4*b*, and the recording element substrate 1 is supported by the surface 4*b* of the insulation member 4, which is opposite to the opposite surface 4*a* facing the support member 2.

The multiple recording element substrates 1 are arranged on the support member 2 in a staggered shape in a longer direction of the head while being alternately staggered from each other in a shorter direction of the head. The arrangement of the recording element substrates 1 is not limited to the staggered arrangement. For example, the recording element substrates 1 may be arranged linearly or may be arranged so as to be tilted at a predetermined angle in the longer direction of the head.

Figure 4:
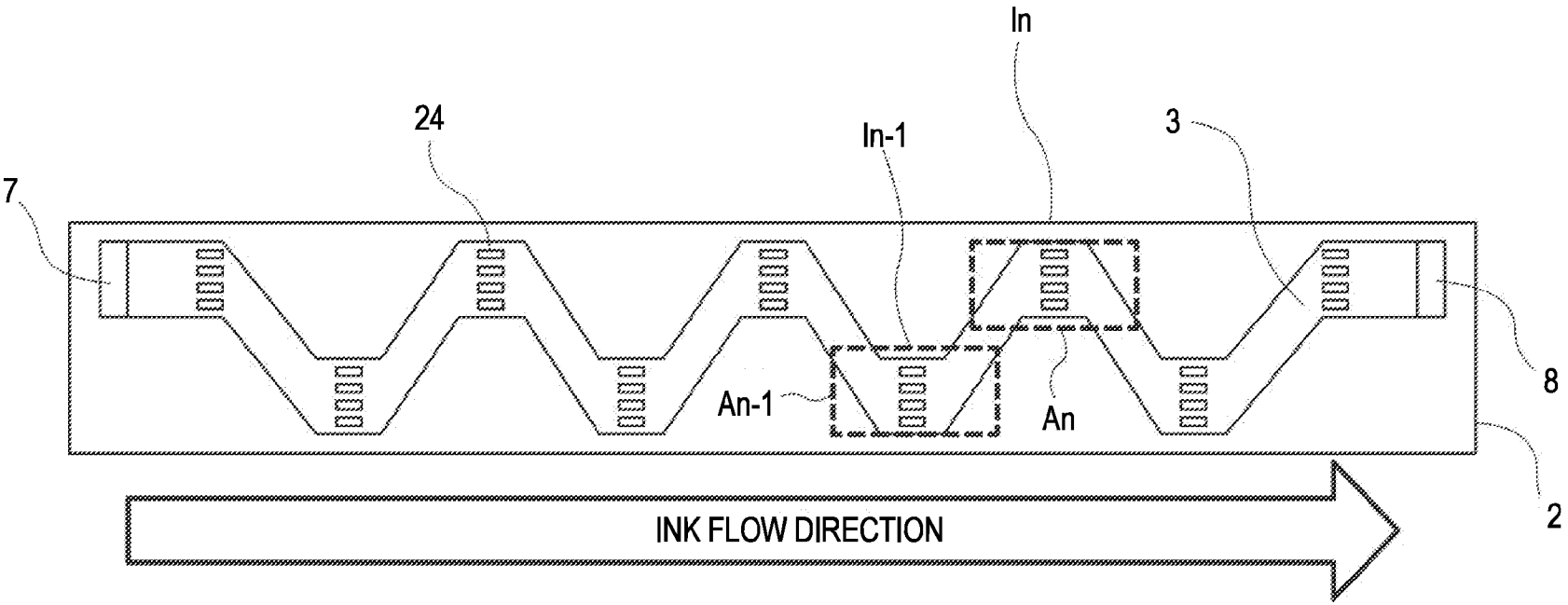
FIG. 4 is a schematic view illustrating an internal structure of a support member.

As illustrated in FIG. 4, a flow path 3 for supplying liquid such as ink is provided in the support member 2 so as to meander in the longer direction of the support member 2. An inflow port 7 and an outflow port 8 are provided at ends of the flow path 3. The support member 2 is provided with a division port 24 communicating with an individual liquid chamber 6 in the insulation member 4.

It is preferred that the support member 2 be made of a material having low thermal expansion coefficient and high thermal conductivity. It is also desired that the support member 2 have stiffness so as to prevent the full-line head from being bent and sufficient corrosion resistance to ink. As the material for the support member 2, for example, alumina, silicon carbide, or graphite can be used preferably. Although the support member 2 may be formed of one plate-shape member, it is preferred that the support member 2 be formed of a laminate of multiple thin alumina layers as illustrated in FIG. 1, because the three-dimensional flow path 3 can be formed in the support member 2.

Figure 5A:
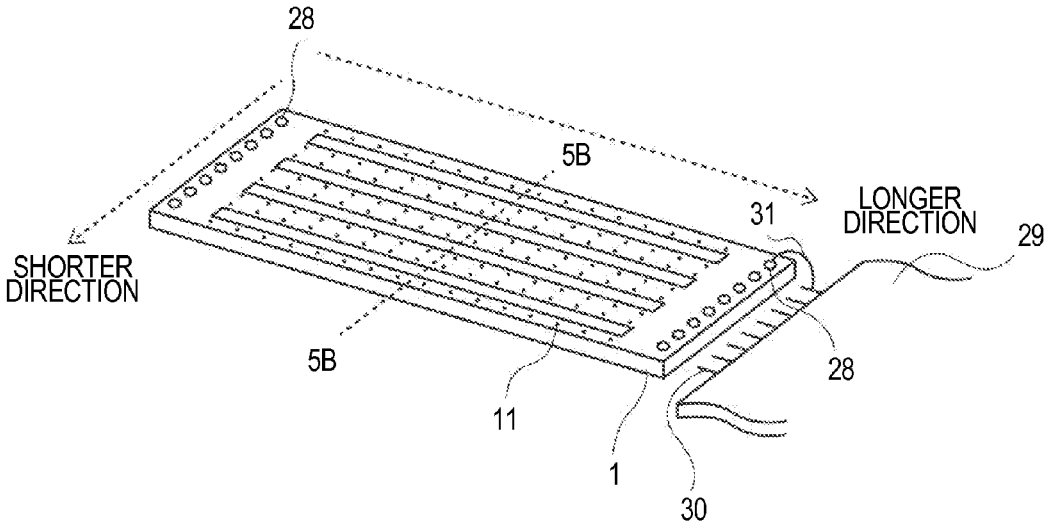
FIG. 5A is a schematic perspective view of a recording element substrate.
Figure 5B:
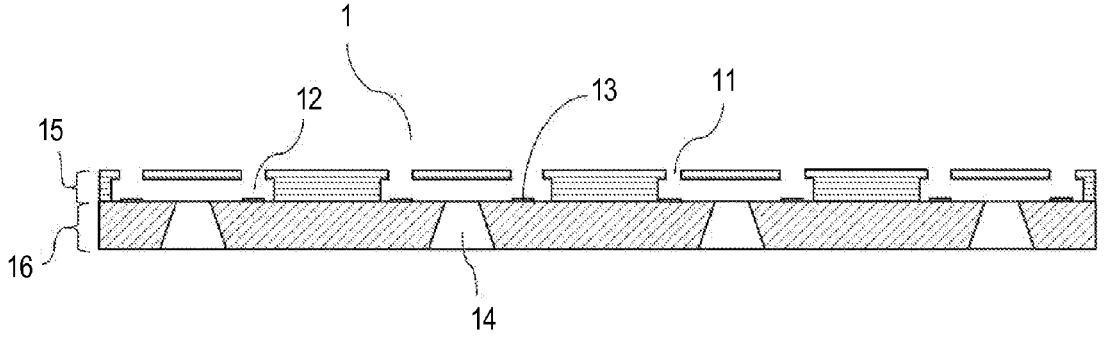
FIG. 5B is a sectional view of the recording element substrate.

FIG. 5A is a schematic perspective view of the recording element substrate 1, and FIG. 5B is a sectional view taken along line 5B-5B of FIG. 5A. The terms "shorter direction" and "longer direction" as used herein respectively refer to the directions illustrated in FIG. 5A. The recording element substrate 1 adopts a thermal system and is formed of a member 15 in which an ejection orifice 11 is formed and a heater board 16. The member 15 includes a foaming chamber 12 and the ejection orifice 11 for ejecting recording liquid droplets. The heater board 16 includes four arrays of supply ports 14 and eight arrays of heat generators 13 formed individually at the position corresponding to the ejection orifice 11. The heat generators 13 are energy-generating elements for generating ejection energy for ejecting recording liquid from the ejection orifice 11 and applying the ejection energy to the recording liquid.

Electric wiring (not shown) is formed in the heater board 16. The electric wiring is electrically connected to a lead electrode 30 of an FPC 29 separately arranged on the head via a signal input electrode 28 of the recording element substrate 1. In this embodiment, the lead electrode 30 is supported by a margin portion, on the periphery of the recording element substrate 1, of the surface 4*b* of the insulation member 4 on which the recording element substrate 1 is mounted. The signal input electrode 28 of the recording element substrate 1 and the lead electrode 30 are electrically connected to each other by wire bonding 31. When a pulse voltage is input to the heater board 16 through the signal input electrode 28 from an external control circuit (not shown), the heat generator 13 is heated and the ink in the foaming chamber 12 is boiled to eject ink liquid droplets from the ejection orifice 11. In this embodiment, as illustrated in FIG. 3B, eight ejection orifice arrays (array of the ejection orifices 11) are formed in the longer direction of each recording element substrate 1.

The insulation member 4 has a function of preventing heat generated from each recording element substrate 1 from being transferred to the support member 2 and the ink flowing therethrough and suppressing thermal conduction between the recording element substrates 1. One or two insulation members 4 may be provided on the support member 2, for example, in the shape of a rectangle, and multiple recording element substrates 1 may be mounted on each insulation member 4. In the above-mentioned configuration, the precision of a positional interval between the recording element substrates 1 mounted on the same insulation member 4 can be ensured easily, and the number of the insulation members 4 becomes small, which results in the reduction of cost. Alternatively, as illustrated in FIG. 1, the insulation members 4 may be provided on the support member 2 individually so as to support the respective recording element substrates 1. The insulation members 4 are arranged at an interval along the flow path 3, and the recording element substrates 1 are provided on the respective insulation members 4. Thus, the thermal conduction between the recording element substrates 1 can be suppressed greatly, and hence, a temperature difference between the recording element substrates 1 (that is, a temperature difference in the head) can be suppressed.

Referring to FIGS. 3A and 3B, the insulation member 4 contains at least one individual liquid chamber 6 for allowing the flow path 3 to communicate with the ejection orifice 11. The individual liquid chamber 6 is provided at a position communicating with the division port 24 and communicates with the supply port 14 of the recording element substrate 1 through a slit hole 9. Consequently, the ink is supplied from the flow path 3 to the ejection orifice 11 through the division port 24, the individual liquid chamber 6, and the supply port 14.

It is preferred that a material for the insulation member 4 have a low thermal conductivity and a small linear expansion coefficient difference with respect to the support member 2 and the recording element substrate 1. Specifically, it is preferred that the material for the insulation member 4 be a resin material, in particular, a composite material obtained by adding an inorganic filler such as silica fine particles to polyphenyl sulfide (PPS) or polysulphone (PSF) which is a base material. When the linear expansion coefficient difference of the insulation member 4 with respect to the support member 2 and the recording element substrate 1 is large, there is such a risk that peeling may occur at the interface 4*b* between the insulation member 4 and the recording element substrate 1 or at the interface 4*a* between the insulation member 4 and the support member 2 in the case where the temperature rises during head driving. Therefore, in this embodiment, the size of the insulation member 4 is reduced by mounting only one recording element substrate 1 on one insulation member 4. However, in the case where the linear expansion coefficient difference is sufficiently small, multiple insulation members 4 may be joined, and multiple recording element substrates 1 may be mounted thereon. Thus, at least one recording element substrate 1 can be mounted on the insulation member 4.

Thermal Resistance of Insulation Member 4

The thermal resistance R of the insulation member 4 is determined by Expression 1.

$$R = \left\{ \frac{L1}{K1 \cdot S1} + \frac{L2}{K2 \cdot S2} + \frac{L3}{K3 \cdot S3} \right\} \quad \text{(Expression 1)}$$

where:

K1: Thermal conductivity of insulation member 4

L1: Thickness in Z direction of insulation member 4

S1: Adhesion area of adhesion portion (adhesive) between insulation member 4 and support member 2

K2: Thermal conductivity of adhesion portion (adhesive) between recording element substrate 1 and insulation member 4

L2: Thickness in Z direction of adhesion portion (adhesive) between recording element substrate 1 and insulation member 4

S2: Adhesion area of adhesion portion between recording element substrate 1 and insulation member 4

K3: Thermal conductivity of adhesion portion (adhesive) between support member 2 and insulation member 4

L3: Thickness in Z direction of adhesion portion (adhesive) between support member 2 and insulation member 4

S3: Adhesion area of adhesion portion (adhesive) between support member 2 and insulation member 4, and the Z direction refers to a size of the insulation member 4 in the thickness direction (see FIG. 3B).

Expression 1 is predicated on the assumption that the insulation member 4 and the recording element substrate 1 are directly adhered to each other with an adhesive. In the case where some member is interposed between the insulation member 4 and the recording element substrate 1, it is appropriate that the term of the thermal resistance of some member be added to the left side of Expression 1.

A thermal resistance R (K/W) of a shortest heat transfer path of the insulation member 4 between the recording element substrate 1 and the support member 2 is set to at least a value obtained by the following Expression 2.

$$R \geq 1.4/\ln\{0.525e^{1.004P}-0.372\}^{-1} \quad \text{(Expression 2)}$$

In Expression 2, P represents energy (μJ/pL) to be input per ejection droplet volume in the energy-generating element.

Figure 6:
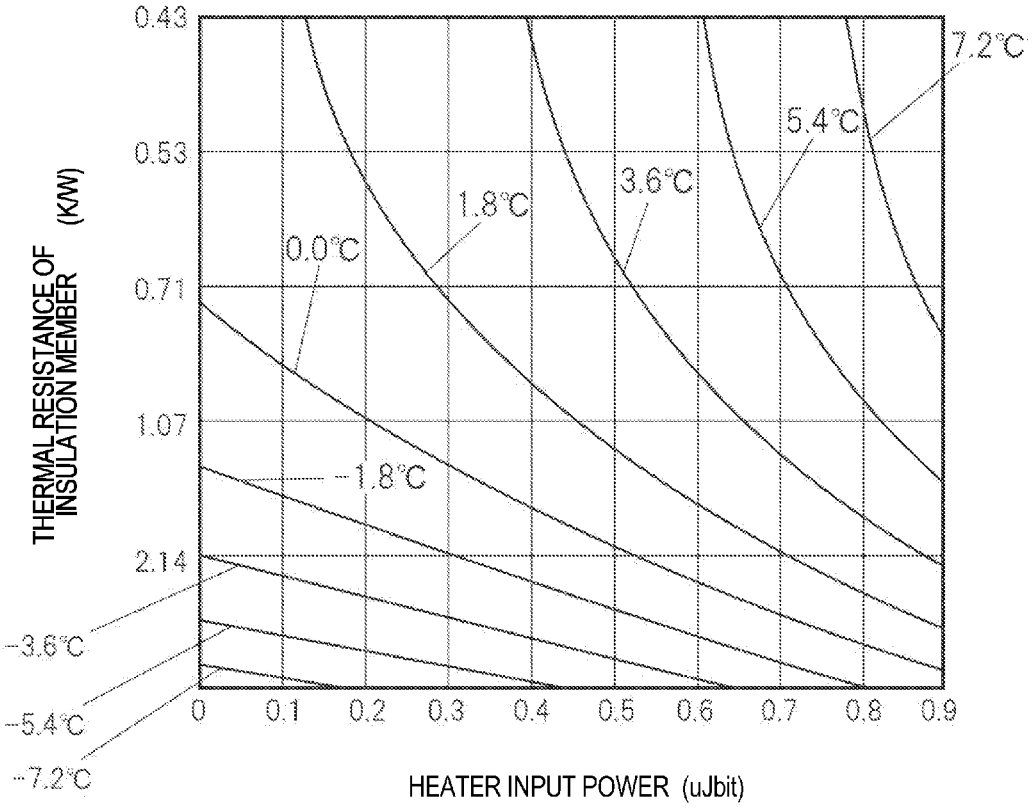
FIG. 6 is a contour map of a temperature difference $\Delta T_{Ink}$ of liquid supplied to a recording element substrate on the most downstream side in the case of increasing a drive frequency per ejection orifice array.

The Expression 2 will be explained below. A difference $\Delta T_{Ink}$ in supply temperature of the recording element substrate 1 positioned on the most downstream side in the case of driving the head illustrated in FIG. 1 under the condition of Table 1 and setting the drive frequency per ejection orifice array to 6.75 kHz and 1.80 kHz was determined by numerical analysis. After that, when $\Delta T_{Ink}$ was represented by contour lines, with the vertical axis representing thermal resistance R and the horizontal axis representing energy P, plots as shown in FIG. 6 were obtained. As is understood from FIG. 6, when the thermal resistance R increases to a predetermined value or more with respect to the energy P, there exists a region satisfying $\Delta T_{Ink} \leq 0$ (that is, however printing is increased in speed to increase a calorific value, the heat discharge amount from the head does not increase). The contour line satisfying $\Delta T_{Ink}=0$ in FIG. 6 corresponds to Expression 2. The thermal conductivity and thickness of the insulation member 4 and the shape of the individual liquid chamber 6 are determined so that the thermal resistance R reaches at least this value. Although FIG. 6 shows the cases where the drive frequency is up to 6.75 kHz, $\Delta T_{Ink} \leq 0$ is also obtained in the case of a higher drive frequency.

As is represented by Expression 2, the energy P to be input per ejection droplet volume in the energy-generating element is dominant for determining the thermal resistance R. The reciprocal of the energy P is a liquid droplet volume that can be ejected per energy. In other words, the reciprocal of the energy P means energy efficiency with respect to one ejection operation. In a recording element substrate having high energy efficiency, a calorific value is small even when printing is performed at high speed, and a temperature difference in the head is small. However, in a recording element substrate having low energy efficiency, as printing is increased in speed, an increment of a calorific value becomes larger, with the result that a temperature difference in the head becomes higher. Accordingly, the preferred range of the thermal resistance R is dominantly influenced by the energy P. Although a procedure for enhancing energy efficiency of the recording element substrate so as to reduce a temperature difference in the head during high-speed printing is effective, a temperature difference in the head tends to increase during printing at higher speed when the value of the thermal resistance R remains smaller than Expression 2. In contrast, the method of setting the thermal resistance R to a value equal to or more than Expression 2 as in this embodiment is useful because a positive correlation between the printing speed and the temperature difference in the head can be fundamentally broken off.

As described above, in the liquid ejection head 5 of this embodiment, the amount of heat discharged to the heat exchanger (cooler) on a recording apparatus main body side by way of circulating ink is reduced during high-speed driving, compared to that during low-speed driving. The reason for this is that when printing is performed at high speed, an ejected ink amount increases, and the heat transfer rate between the recording element substrate 1 and the ejection ink increases and the insulation between the recording element substrate 1 and the support member 2 is enhanced compared to that during low-speed driving. In a conventional full-line head with a cooling mechanism, generally, when the calorific value increases along with an increase in printing speed, a cooling heat value required on the recording apparatus main body side also increases. However, in the head of this embodiment, such a preferred effect that as a calorific value increases along with an increase in printing speed, power consumption for cooling the recording apparatus main body decreases in a self-controlled manner can be obtained. Further, a radiation system of a main body of the liquid ejection apparatus can be simplified and reduced in cost.

Further, by setting the thermal resistance R to at least a value calculated from Expression 2, a temperature difference between the recording element substrates 1 (temperature difference in the head) can be reduced. The insulation member 4 also serves as a support substrate for the recording element substrate 1, and hence, the heat generated in the recording element substrate 1 is insulated in the vicinity of the surface 4*b* of the insulation member 4 for supporting the recording element substrate 1 and thereby is unlikely to be transferred to the support member 2. This can also suppress a rise in temperature of the support member 2 in the vicinity of the division port 24 and prevent the ink from being heated in the vicinity of the division port 24. Therefore, a temperature difference between the upstream side and the downstream side in the flow path 3 is suppressed. This reduces a temperature difference of the ink supplied to the respective recording element substrates 1, and even in the case where a calorific value from the recording element substrate 1 is large during high-speed printing or the like, a temperature difference in the head can be reduced. Accordingly, even with a long full-line head, image quality with less unevenness can be obtained during high-speed printing.

The thermal resistance R of the shortest heat transfer path of the insulation member 4 between the recording element substrate 1 and the support member 2 is preferably 2.5 (K/W) or more, more preferably 12.4 (K/W) or more. With this, even in the case where energy required per ejection (hereinafter sometimes referred to as "ejection energy") is high, a temperature difference of ink in the head can be reduced without increasing the amount of heat discharged to the outside of the head. Thus, a printed image particularly requiring high image quality, such as a photograph, can be printed at high speed.

It is further preferred that the thermal resistance R of the insulation member 4 be distributed in the head so as to be larger in both end portions in the head longer direction, compared to that in a center portion. The temperatures of both the end portions of the head tend to become low because the heat discharge to the surrounding environment is larger than that of the other portions. Therefore, by setting the thermal resistance R in both the end portions to be higher than that of the other positions, a temperature difference between the recording element substrates 1 can be further suppressed.

When the ejection orifice 11 is driven at a drive frequency of 1.8 kHz or less, ejection energy per unit time to be applied from the heat generator 13 (energy-generating elements) to the ink is defined as Q, and a heat discharge per unit time to be transferred from the heat generator 13 as a generation source to the support member 2 is defined as Q'. The thermal conductivity and thickness of the insulation member 4 and the shape of the individual liquid chamber 6 are determined so that the ratio Q/Q' between the ejection energy Q and the heat discharge Q' is 5.1 or more.

When the ratio Q/Q' is set to 5.1 or more, most of the calorific value of each recording element substrate 1 is transferred to ink to be ejected, and the heat transfer amount from the recording element substrate 1 to the ink in the support member 2 is reduced greatly. Therefore, a phenomenon in which the ink that receives heat on the upstream side of the flow path 3 to be heated is supplied to the recording element substrate 1 on the downstream side becomes unlikely to occur, and a temperature difference of ink in the head can be reduced. Accordingly, unevenness does not occur easily even under maximum load.

The ratio Q/Q' changes depending on the drive frequency per ejection orifice array of the recording element substrate 1 and increases when the drive frequency increases. The reason for this is as follows: the flow velocity of ejection ink in the recording element substrate 1 increases due to an increase in drive frequency, and hence, the heat transfer rate between the recording element substrate 1 and the ejection ink increases. Therefore, in the case where the drive frequency per ejection orifice is as low as 1.8 kHz or less, when the ratio Q/Q' is 5.1 or more, even if the ejection energy Q increases at a high-speed drive frequency higher than 1.8 kHz, the ratio Q/Q' increases, and hence, an increase in the heat discharge Q' is suppressed. Accordingly, an increase in temperature difference of ink in the head can be suppressed.

It is preferred that the ratio Q/Q' be set to 13.6 or more. A temperature difference of ink in the head can be further reduced, and a printed image particularly requiring high image quality, such as a photograph, can be printed at high speed while visually recognizable unevenness is suppressed.

The shape of the individual liquid chamber 6 influences the contact area between the insulation member 4 and the support member 2 and a flow of the ink in the individual liquid chamber 6 during ejection driving, and hence, influences the values of the thermal resistance R and the heat discharge Q'. However, as long as the thermal resistance R satisfies Expression 2 and the ratio Q/Q' is 5.1 or more, there is no limit to the shape of the individual liquid chamber 6. Note that, bubbles may be generated in the individual liquid chamber 6 when the head is filled with ink, and hence, the shape of the individual liquid chamber 6 illustrated in FIG. 3A is one of preferred shapes from the viewpoint of the ease of removing bubbles. In FIG. 3A, the downward direction in the figure corresponds to the vertical upward direction, and the individual liquid chamber 6 is tapered. Therefore, bubbles accumulated in the individual liquid chamber 6 are easily discharged to the flow path 3 by virtue of buoyant force.

By setting the heat discharge Q' transferred to the support member 2 during driving under maximum load to a value determined by Expression 3 regarding all the recording element substrates 1, a temperature difference of ink in the head can be sufficiently reduced to such a degree that visually recognizable unevenness does not occur. The heat discharge transferred to the support member 2 may be less than the heat discharge Q'.

$$Q' = \frac{(\Delta Vd / Vd) \cdot Cp}{(C/100) \cdot \sum_{n=1}^{N} (F + f(N-n+1))^{-1}} \quad \text{(Expression 3)}$$

Vd: Ejection amount per ejection operation from one ejection orifice (ng)

C: Temperature coefficient of Vd (%/K)

ΔVd: Deviation of Vd causing visually recognizable unevenness (ng)

Cp: Specific heat of ink (W/g/K)

F: Flow rate of ink at exit of flow path (g/s)

(*in the case where ink is not circulated in the head, F=0)

f: Ejection amount per recording element substrate during driving under maximum load (g/s)

N: Total number of recording element substrates

This expression is obtained as follows. As illustrated in FIG. 4, the insulation member 4 corresponding to the (n−1)th recording element substrate 1 in the flow direction of the ink in the flow path 3 is defined as an insulation member $A_{n-1}$, and the insulation member 4 corresponding to the nth recording element substrate 1 is defined as an insulation member $A_n$. A surface on which the insulation member $A_{n-1}$ comes into contact with the support member 2 is defined as an ink region $I_{n-1}$, a surface on which the insulation member $A_n$ comes into contact with the support member 2 is defined as an ink region $I_n$, average temperature of the ink in the ink region $I_{n-1}$ is defined as $T_{n-1}$, and average temperature of the ink in the ink region $I_n$ is defined as $T_n$. A temperature difference between $T_n$ and $T_{n-1}$ when the heat discharge Q' is transferred from the (n−1)th recording element substrate 1 to the support member 2 through the insulation member $A_{n-1}$ is represented by the following expression:

$$T_n - T_{n-1} = Q'/(Cp \cdot f_n) \quad \text{(Expression 4).}$$

In Expression 4, $f_n$ represents an ink flow rate in the ink region $I_n$. During driving under maximum load at which a temperature difference of the ink in the head becomes maximum, an ink flow rate in the flow path 3 decreases toward the downstream side by the ink amount ejected from each recording element substrate 1, and hence, the ink flow rate $f_n$ in the ink region $I_n$ is represented by the following expression:

$$f_n = F + f \cdot (N-n+1) \quad \text{(Expression 5).}$$

When Expression 5 is substituted into Expression 4, and n is substituted successively from 1, the following is obtained:

$$T_1 - T_0 = Q'/Cp/(F + f \cdot N)$$

$$T_2 - T_1 = Q'/Cp/(F + f \cdot (N-1))$$

$$T_3 - T_2 = Q'/Cp/(F + f \cdot (N-2))$$

$$T_4 - T_3 = \ldots$$

When the expressions are summed up to n=N, Expression 6 is obtained.

$$T_N - T_0 = Q' / Cp \cdot \sum_{n=1}^{N} \{F + f(N-n+1)\}^{-1} \quad \text{(Expression 6)}$$

On the other hand, the temperature difference causing visually recognizable unevenness can be expressed by the following expression:

$$\Delta T = \Delta Vd/Vd/(C/100) \quad \text{(Expression 7).}$$

When the left side of Expression 6 is larger than the left side of Expression 7, visually recognizable unevenness is caused in an image. Therefore, from Expression 6 and Expression 7, the maximum value of the heat discharge Q' for not causing visually recognizable unevenness even during driving under maximum load is determined by the following expression.

$$Q' = \frac{(\Delta Vd/Vd)\cdot Cp}{(C/100)\cdot \sum_{n=1}^{N} (F + f(N-n+1))^{-1}} \quad \text{(Expression 3)}$$

Expression 3 is obtained as described above.

Description of Recording Driving Operation

Next, a specific operation in the case of driving the liquid ejection head 5 described above is described. First, referring to FIG. 7, a configuration of a liquid ejection apparatus 32 including the liquid ejection head 5 is described.

A resin tube 26 communicating with a temperature adjusting tank 20 is joined to the inflow port 7 of the liquid ejection head 5, and a tube 27 communicating with a circulation pump 17 is joined to the outflow port 8 of the liquid ejection head 5. The tubes 26 and 27 form ink circulation paths 26 and 27 provided outside of the liquid ejection head 5, and the circulation pump 17 forms an ink circulation unit 17 provided outside of the liquid ejection head 5. The temperature adjusting tank 20 is joined to a heat exchanger 33 so as to exchange heat. The temperature adjusting tank 20 serves to supply ink to the liquid ejection head 5 and maintain the ink that is being refluxed through the circulation pump 17 at predetermined temperature. The temperature adjusting tank 20 includes an external air communication hole (not shown) and can discharge bubbles in the ink to the outside.

A supply pump 18 can transfer ink, which has been supplied from an ink tank 21 and from which foreign matter has been removed by a filter 19, to the temperature adjusting tank 20. Further, the supply pump 18 can supply the same amount of ink as that ejected from the liquid ejection head 5 by printing to the temperature adjusting tank 20. The ink tank 21 is further joined to a cooler 22 so as to exchange heat. When the cooler 22 is driven, the ink in the ink tank 21 is cooled to lower the ink supply temperature at the inflow port 7 of the liquid ejection head 5, and the ink can be supplied to the flow path 3. It is preferred that the head inlet temperature of the ink be lower than ordinary temperature (for example, 25° C.).

In this embodiment, most of the heat is discharged from ejection ink, and hence, the temperatures of the recording element substrate 1 and the ejection ink become high. When the temperature of the ink becomes high, there is such a risk that undesirable phenomena such as the degradation of an ink composition and the fixing of ink in the vicinity of the ejection orifice may occur depending on the kind of the ink. By cooling the ink, an excessive rise in temperature of the ink to be ejected from the liquid ejection head 5 is prevented, and the undesired phenomena such as the degradation of an ink composition and the fixing of the ink in the vicinity of the ejection orifice can be suppressed.

The FPC 29 is mounted on the liquid ejection head 5 and is electrically connected to the signal input electrodes 28 of each recording element substrate 1. By transmitting an ejection signal from the external control circuit (not shown) in accordance with image data to the heat generator 13 of each recording element substrate 1 through the FPC 29, the ink is ejected from the ejection orifice 11 and a printing operation is performed.

When the ink is ejected from the recording element substrate 1, most of the heat generated from the heat generator 13 is transferred to the ink to be ejected. The remaining heat is transferred to the recording element substrate 1 and then to the insulation member 4, and transferred to the support member 2 and the ink in the flow path 3. Therefore, a rise in temperature of the entire liquid ejection head 5 cannot be prevented completely.

Of the entire calorific value generated in the recording element substrate 1 during head driving, the remaining heat discharge Q' obtained by excluding the ejection energy Q transferred to the ejection ink is transferred to the support member 2 through the insulation member 4 and a sealing agent (not shown) and then transferred to the ink in the flow path 3. In this case, the sealing agent serves to seal a wire bonding portion 31 between the signal input electrode 28 of each recording element substrate 1 and the lead terminal 30 of the FPC 29, and is arranged across the FPC 29 and the insulation member 4.

The ink having absorbed heat from the recording element substrate 1 on the most upstream side of the flow path 3 flows through the flow path 3 while raising its temperature and further absorbs heat in the division port 24 of the subsequent recording element substrate 1. Thus, the ink absorbs heat from each recording element substrate 1 while raising its temperature in the flow path 3, and hence, the temperature of the ink supplied to the recording element substrates 1 becomes higher toward the downstream side, which causes a temperature difference of the recording element substrates 1 between the upstream side and the downstream side (that is, a temperature difference in the head).

In the liquid ejection head 5 of this embodiment, the ejection energy Q from the recording element substrate 1 to the ejection ink is set to be 10 times or more as much as the heat discharge Q' from the recording element substrate 1 to the support member 2, and hence, the heat amount transferred to the flow path 3 in the support member 2 is 1/11 or less of the total calorific value. Therefore, a rise in temperature of the ink in the flow path 3 can be suppressed. Thus, a temperature difference of the ink in the head can be reduced, and a rise in temperature of the ink in the head can be suppressed within such a range that unevenness does not occur.

Figure 7:
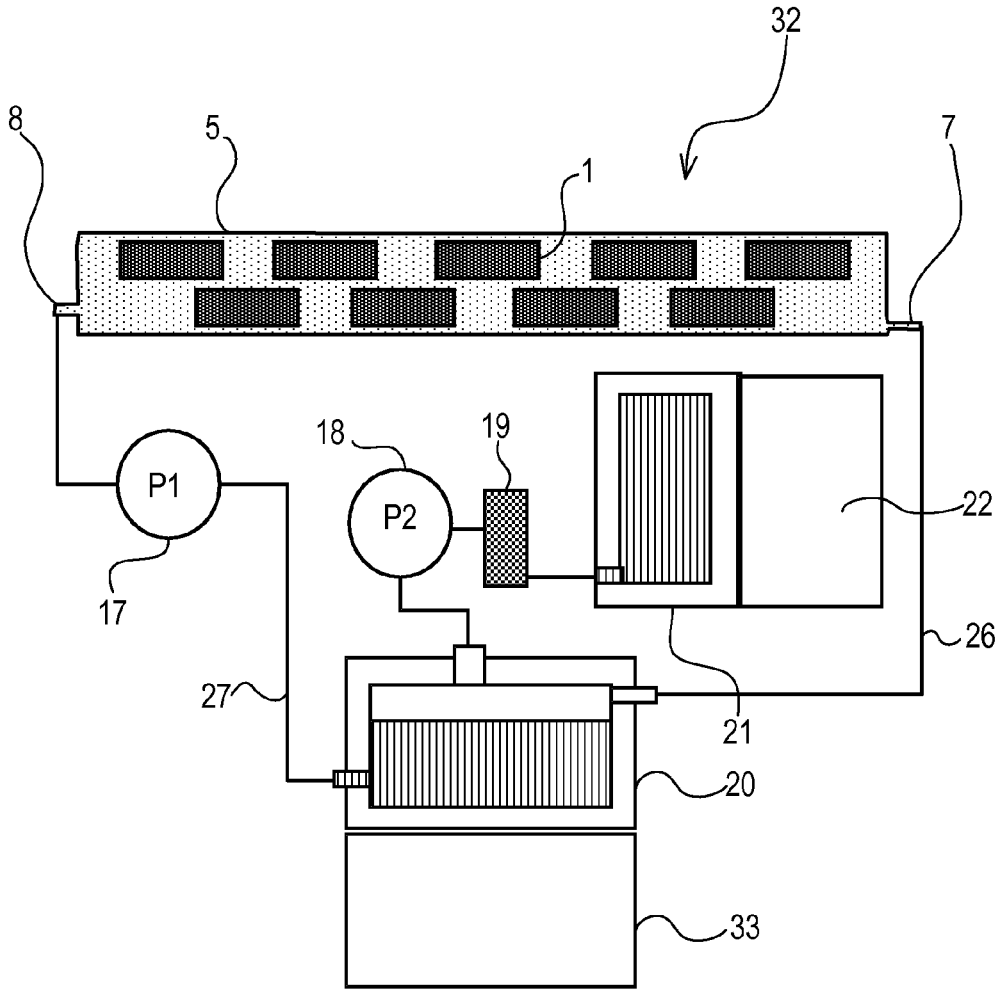
FIG. 7 is a schematic view of a supply system of a liquid ejection apparatus.

When the ink in the flow path 3 is allowed to circulate by operating the circulation pump 17 of FIG. 7 during head driving, the ink accumulated in the flow path 3 is discharged and new ink is supplied into the head through the inflow port 7. Therefore, the temperature of the head can be lowered.

Second Embodiment

Figure 8:
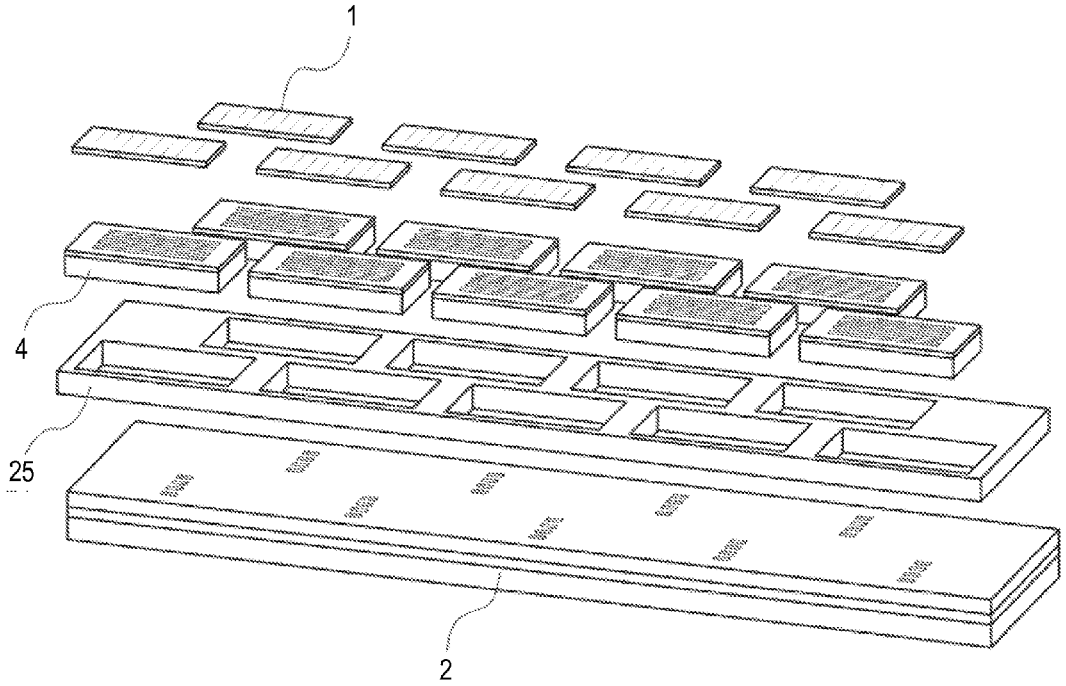
FIG. 8 is an exploded perspective view of a liquid ejection head according to a second embodiment of the present invention.

FIG. 8 is an exploded view of a liquid ejection head 5 in a second embodiment of the present invention. As is understood from FIG. 8, a terminal support 25 is provided on the support member 2 and between the insulation members 4 to be adjacent thereto. The terminal support 25 is arranged so as to support the lead terminal 30 of the FPC 29 electrically connected to the signal input electrode 28 of the recording element substrate 1. A modulus of elasticity of the terminal support 25 is set to be higher than that of the insulation member 4. In the first embodiment, a lead terminal supporting portion is provided in a margin portion of the surface 4*b* of the insulation member 4 for supporting the recording element substrate 1. Therefore, in the case where the insulation member 4 has a low modulus of elasticity, the insulation member 4 is deformed during wire bonding connection, and wire connection may become insufficient. In contrast, in the second embodiment, the terminal support 25 having a modulus of elasticity higher than that of the insulation member 4 supports the lead terminal 30, and hence, the reliability of the wire bonding connection can be enhanced.

Third Embodiment

Figure 9:
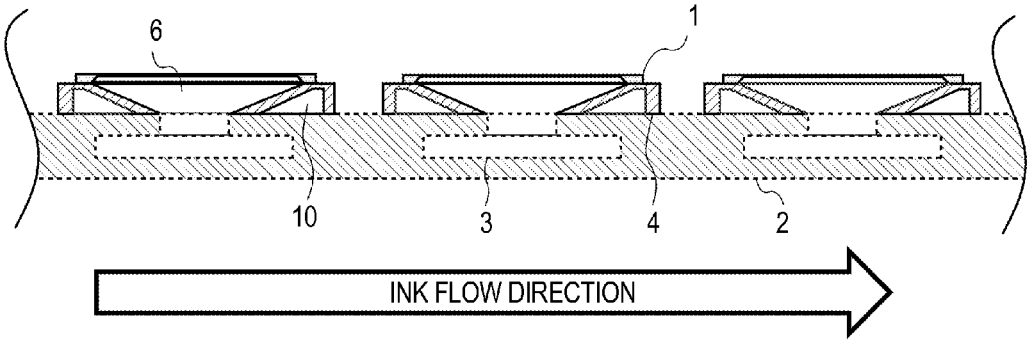
FIG. 9 is a schematic sectional view of a liquid ejection head according to a third embodiment of the present invention.

As illustrated in FIG. 9, a space portion 10 partitioned from the individual liquid chamber 6 is provided in the insulation member 4. In this case, the insulation of the insulation member 4 can be enhanced and the thermal resistance R and the ratio Q/Q' can be increased. Providing the space portion 10 prevents cooling in the case of a full-line head which performs conventional cooling, and hence, is avoided according to the technical common sense. However, in the full-line head of the third embodiment, beneficial effects are rather obtained. Accordingly, in the third embodiment, a temperature difference of ink in the head can be further reduced.

Fourth Embodiment

In a liquid ejection head of a fourth embodiment of the present invention, the recording element substrate 1 is insulated from the other members depending on the thermal resistance R of the insulation member 4, and hence, depending on the value of the energy P (μJ/pL) to be input per ejection droplet volume, the liquid ejection head of the fourth embodiment is driven at relatively higher temperature than that of general liquid ejection heads. In this case, in order to maintain a small temperature difference between the temperature during printing standby and the temperature during driving, it is necessary to control the temperature of the recording element substrate 1 during printing standby by a sub-heater provided in the recording element substrate 1. However, during temperature control standby, the ink in the individual liquid chamber 6 is accumulated and raises its temperature by receiving the heat generated from the sub-heater of the recording element substrate 1. Therefore, when printing is resumed, the ink whose temperature has been raised receives the heat generated from the recording element substrate 1 to raise its temperature further, and the temperature of the recording element substrate 1 rises. In this case, when ejection is continued, the amount of the hot ink in the individual liquid chamber decreases, and the temperature of the recording element substrate 1 falls finally. However, when the temperature of the recording element substrate 1 rises too excessively although it is transient, the ejection state of the ink may be disturbed, or a driver IC circuit of the recording element substrate 1 may operate abnormally. Even in the case where the amount of a rise in temperature is not so excessive, assuming the use in printing for business such as repeated printing of the same multiple images, it is required to reduce a temperature difference between printed images so as to maintain the quality of the images to be uniform.

Figure 10A:
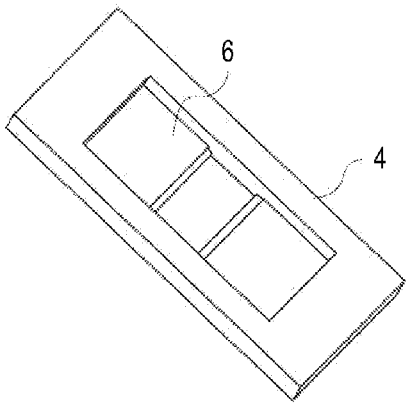
FIGS. 10A, 10B, 10C, 10D and 10E are schematic views each illustrating an insulation member according to a fourth embodiment of the present invention.
Figure 10B:
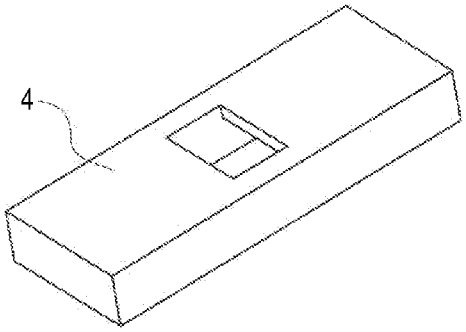
Figure 10C:
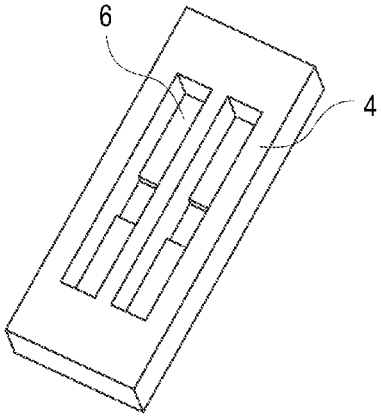
Figure 10D:
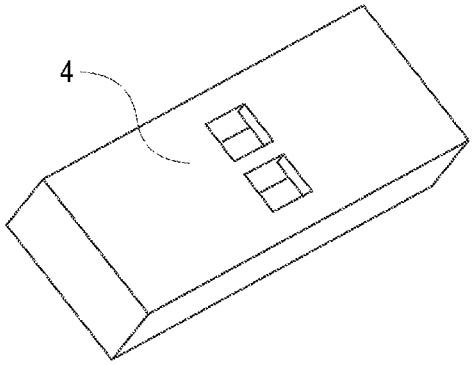

In order to solve the above-mentioned problem, as illustrated in FIGS. 10A to 10E, the width of the individual liquid chamber 6 in the insulation member 4 in a paper conveyance direction or an ejection orifice array direction is set to 3 mm or more. FIGS. 10A and 10B each illustrate a configuration in which only one individual liquid chamber 6 is provided in the insulation member 4, and FIGS. 10C and 10D illustrate a configuration in which two individual liquid chambers 6 are provided in the insulation member 4.

Figure 10E:
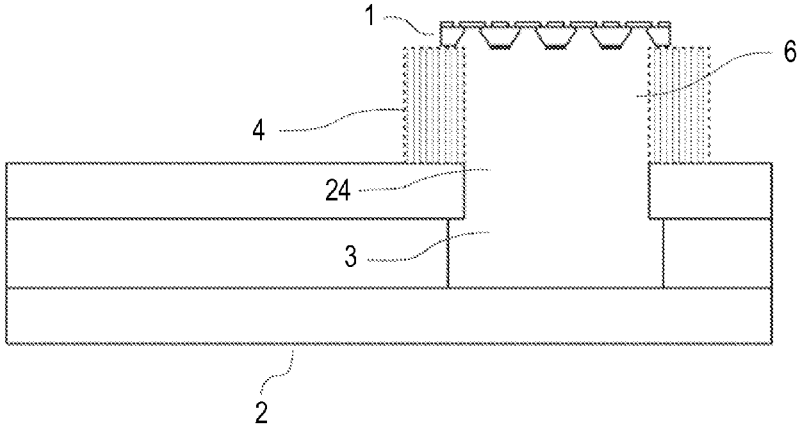

In the case of using the above-mentioned insulation members 4, as illustrated in FIG. 10E, one individual liquid chamber 6 is arranged across the multiple supply ports 14 of the recording element substrate 1. With this, natural convection is allowed to occur easily in the individual liquid chamber 6 during printing standby, and a rise in temperature of the ink in the individual liquid chamber 6 can be suppressed. Thus, a transient rise in temperature of the recording element substrate 1 when printing is resumed can be suppressed. When the width of the individual liquid chamber 6 in the insulation member 4 in the paper conveyance direction or the ejection orifice array direction is 3 mm or less, a convection speed in the individual liquid chamber 6 decreases, and hence, a transient rise in temperature cannot be suppressed sufficiently.

Example 1

As Example 1, numerical analysis was performed in the case of connecting the liquid ejection head 5 of FIG. 1 to the ink circulation paths 26 and 27 as illustrated in FIG. 7 and driving the liquid ejection head 5 under the condition shown in Table 1. The recording element substrate 1 was provided with eight ejection orifice arrays as illustrated in FIGS. 5A and 5B so that the eight arrays were equally dispersedly driven with respect to a recording image to drive ejection.

In Example 1, a material (thermal conductivity: 0.8 (W/m/K)) obtained by adding a silica filler to PPS was used as the insulation member 4, and the thermal resistance R of the insulation member 4 was set to 31.0 (K/W).

In the numerical analysis, nine recording element substrates 1 were mounted on the liquid ejection head 5, and alumina was used as the material for the support member 2. A thermal resistance corresponding to a thickness of 45 μm of a resin adhesive (thermal conductivity of 0.2 (W/m/K)) was considered between each recording element substrate 1 and the insulation member 4. A thermal resistance corresponding to a thickness of 75 μm of the adhesive was considered between each insulation member 4 and the support member 2. The heat radiation to air was ignored.

Comparative Example 1

Numerical analysis was performed in the case of performing driving under the same dimension and condition as those of Example 1 except for setting the thermal conductivity of the insulation member 4 to 48 (W/m/K) and the thermal resistance R to 0.5 (K/W) in Example 1. The thermal resistance between each insulation member 4 and the support member 2 was ignored.

Comparative Example 2

Numerical analysis was performed in the case of driving under the same dimension and condition as those of Example 1 except for integrating the insulation member 4 made of alumina with the support member 2 and setting the thermal resistance R to 1.0 (K/W) in Example 1. A thermal resistance corresponding to a thickness of 5 μm of a resin adhesive was considered between each recording element substrate 1 and the insulation member 4.

Example 2

Numerical analysis was performed in the case of driving under the same dimension and condition as those of Example 1 except for setting the thermal conductivity of the insulation member 4 to 10 (W/m/K) and the thermal resistance R to 2.5 (K/W) in Example 1.

Example 3

Numerical analysis was performed in the case of driving under the same dimension and condition as those of Example 1 except for setting the thermal conductivity of the insulation member 4 to 5 (W/m/K) and the thermal resistance R to 5.0 (K/W) in Example 1.

Example 4

Numerical analysis was performed in the case of driving under the same dimension and condition as those of Example 1 except for setting the thermal conductivity of the insulation member 4 to 2 (W/m/K) and the thermal resistance R to 12.4 (K/W) in Example 1.

Example 5

Numerical analysis was performed in the case of driving under the same dimension and condition as those of Example 1 except for setting the thickness of the insulation member 4 in a gravity direction to ⅗ of that in Example 1 and setting the thermal resistance R to 18.6 (K/W).

Example 6

Numerical analysis was performed in the case of driving under the same dimension and condition as those of Example 1 except for setting the thickness of the insulation member 4 in a gravity direction to ⅘ of that in Example 1 and setting the thermal resistance R to 24.8 (K/W).

Example 7

Numerical analysis was performed in the case of driving under the same dimension and condition as those of Example 1 except for providing the space portion in the insulation member 4 as illustrated in FIG. 9 and setting the thermal resistance R to 65.5 (K/W) in Example 1.

Example 8

Numerical analysis was performed in the case of driving under the same dimension and condition as those of Example 1 except for setting the thermal conductivity of the insulation member 4 to 0.2 (W/m/K) and the thermal resistance R to 63.6 (K/W) in Example 1.

Figure 11:
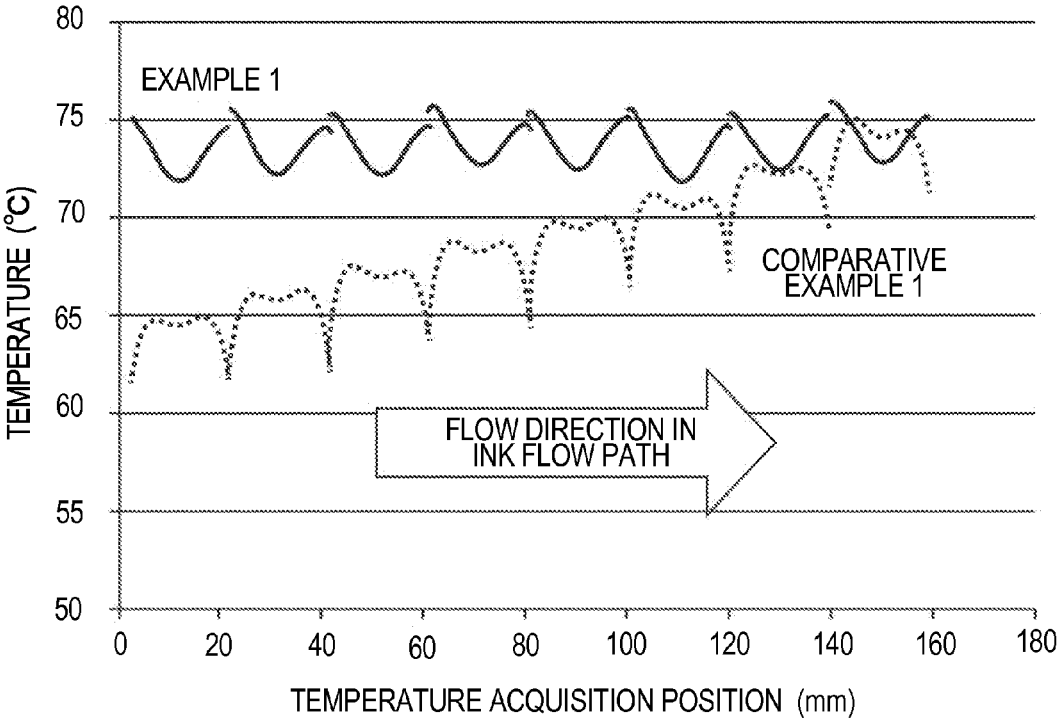
FIG. 11 is a graph showing a temperature distribution of each recording element substrate in a flow direction of a flow path.

FIG. 11 shows results of the numerical analysis of a surface temperature distribution in the longer direction of the recording element substrate 11 in Example 1 and Comparative Example 1. The temperature distribution of each recording element substrate 1 was calculated by averaging temperature distributions in the longer direction of the four arrays of division ports 24 of the recording element substrate 1 of FIGS. 5A and 5B. In FIG. 11, the left side corresponds to the inflow port 7, and the ink flows through the flow path 3 toward the right side. As is understood from FIG. 11, in Comparative Example 1, although the temperature of the recording element substrate 1 on the upstream side of the flow path 3 is low, the temperature of the recording element substrate 1 rises more as closer to the downstream side, and a temperature difference of the ink in the head reaches about 13.5° C. In contrast, in Example 1, the heat transfer amount to the support member 2 is suppressed due to the function of the insulation member 4. Therefore, a temperature difference between the recording element substrates 1 is small, and a temperature difference of the ink in the head is greatly reduced to about 4.1° C. or less. In Example 4, although the temperature of the recording element substrate 1 on the ink upstream side is higher than that of Comparative Example 1, the temperature of the recording element substrate 1 on the ink upstream side can be lowered, for example, by driving the cooler 22 of FIG. 7 to lower the ink supply temperature.

Tables 2 and 3 show the ratio Q/Q', a value obtained by summing up the heat discharges Q' of nine recording element substrates 1 (total Q'), a temperature difference in the head, and an ejection amount change (ΔVd/Vd) caused by the temperature difference in the head. Table 2 shows the case where a drive frequency per ejection orifice array is 1.8 (kHz), and Table 3 shows the case where a drive frequency per ejection orifice array is 6.75 (kHz). The value of a temperature coefficient C of Vd was set to 0.92 (%/K). The total heat discharge Q' from the recording element substrate 1 to the support member 2 was determined by calculation from a difference in ink temperature between the outflow port 8 and the inflow port 7 of the flow path 3.

An allowable temperature difference of the ink in the head can be determined based on the ejection liquid droplet volume change (ΔVd/Vd) which does not cause visually recognizable unevenness in an image to be recorded. Tables 2 and 3 show results of determining image quality based on whether or not the unevenness of a printed image can be visually recognized, with an image quality determination criterion being $\Delta Vd/Vd<10\%$. In Tables 2 and 3, in the case of $\Delta Vd/Vd\leq 5\%$, high image quality corresponding to photograph image quality is obtained, and hence, "Excellent" is described in an image quality column.

The image quality determination criterion was not satisfied in Comparative Examples 1 and 2 because a temperature difference of the ink in the head was large when a drive frequency per ejection orifice array was 6.75 kHz, whereas images of high quality satisfying the image quality determination criterion were obtained in Examples 1 to 8. In particular, in the case of Examples 1 and 4 to 8 in which the thermal resistance R was 12.4 or more, high image quality was obtained. Thus, in the liquid ejection head 5 having the configuration of this embodiment, a temperature deviation in the head can be reduced even during high-speed driving, and hence, a recorded image of high quality can be obtained.

In Examples 1 to 8 and Comparative Examples 1 and 2, the ejection energy was set to 0.5 (μJ/bit), and hence, the heat discharge amount to the outside of the head does not increase even during high-speed printing as long as the thermal resistance R satisfies $R\geq 2.0$ (K/W) based on Expression 2. Actually, when the total heat discharge Q', that is, the heat discharge amount to the recording apparatus main body side is paid attention to in Tables 2 and 3, it is understood that the heat discharge amount is smaller during high-speed driving in which the calorific value is larger, compared to that during low-speed driving in Examples 1 to 8 in which $R\geq 2.0$ is satisfied. In the conventional full-line head with a cooling mechanism, generally, when the calorific value increases along with an increase in printing speed, the cooling heat value required on the recording apparatus main body side also increases. In contrast, in the liquid ejection head 5 of this embodiment, the following preferred effect can be obtained: as a calorific value increases along with an increase in printing speed, a cooling heat value required on the recording apparatus main body side decreases in a self-controlled manner. Thus, in the inkjet full-line head of this embodiment, a temperature difference of ink in the head can be reduced, and moreover, power consumption for cooling the recording apparatus main body can also be reduced.

It is understood from the comparison between Examples 1 and 7 that the heat discharge amount to the recording apparatus main body side is suppressed more in Example 7 in which the space portion is provided in the insulation member 4.

TABLE 1

| | |
|---|---|
| Image size | L-size |
| Printing speed (PPM) | 80, 300 |
| Lateral feeding | |
| Drive frequency per nozzle array (kHz) | 1.8, 6.75 |
| Printing load (%) | 130% |
| Image resolution (dpi) | 1,200 |
| Liquid droplet volume (pL) | 2.8 |
| Ejection energy (μJ/bit) | 0.5 |
| Ink circulation amount (mL/min) | 25 |
| Ink supply temperature (° C.) | 26.85 |
| Ink specific gravity | 1.08 |

TABLE 2

| | | Drive frequency per nozzle array 1.8 kHz Total calorific value Q = 56.7 (W) | | | | |
|---|---|---|---|---|---|---|
| | Thermal resistance R | Q/Q' | Temperature difference in head (° C.) | Total Q' (W) | ΔVd/Vd | Image quality |
| Comparative Example 1 | 0.5 | 2.9 | 10.8 | 19.2 | 10% | Poor |
| Comparative Example 2 | 1.0 | 3.3 | 9.6 | 17.1 | 9% | Good |
| Example 2 | 2.5 | 5.1 | 5.5 | 11.1 | 5% | Excellent |
| Example 3 | 5.0 | 7.1 | 3.8 | 7.9 | 3% | Excellent |
| Example 4 | 12.4 | 13.6 | 3.2 | 4.2 | 3% | Excellent |
| Example 5 | 18.6 | 19.3 | 3.0 | 2.9 | 3% | Excellent |
| Example 6 | 24.8 | 24.9 | 2.8 | 2.3 | 3% | Excellent |
| Example 1 | 31.0 | 30.5 | 2.7 | 1.9 | 2% | Excellent |
| Example 7 | 65.5 | 58.4 | 2.3 | 1.0 | 2% | Excellent |
| Example 8 | 124.0 | 86.1 | 2.0 | 0.7 | 2% | Excellent |

TABLE 3

| | Drive frequency per nozzle array 6.75 kHz Total calorific value in head Q = 212.5 (W) | | | | |
|---|---|---|---|---|---|
| | Q/Q' | Temperature difference in head (° C.) | Total Q' (W) | ΔVd/Vd | Image quality |
| Comparative Example 1 | 2.7 | 13.5 | 21.3 | 12% | Poor |
| Comparative Example 2 | 12.2 | 10.7 | 17.4 | 10% | Poor |
| Example 2 | 22.6 | 7.4 | 9.4 | 7% | Good |
| Example 3 | 34.5 | 6.5 | 6.2 | 6% | Good |
| Example 4 | 71.3 | 5.2 | 3.0 | 5% | Excellent |
| Example 5 | 101.2 | 4.7 | 2.1 | 4% | Excellent |
| Example 6 | 128.7 | 4.3 | 1.7 | 4% | Excellent |
| Example 1 | 154.1 | 4.1 | 1.4 | 4% | Excellent |
| Example 7 | 237.8 | 3.3 | 0.9 | 3% | Excellent |
| Example 8 | 345.0 | 2.8 | 0.6 | 3% | Excellent |

Example 9

Figure 12:
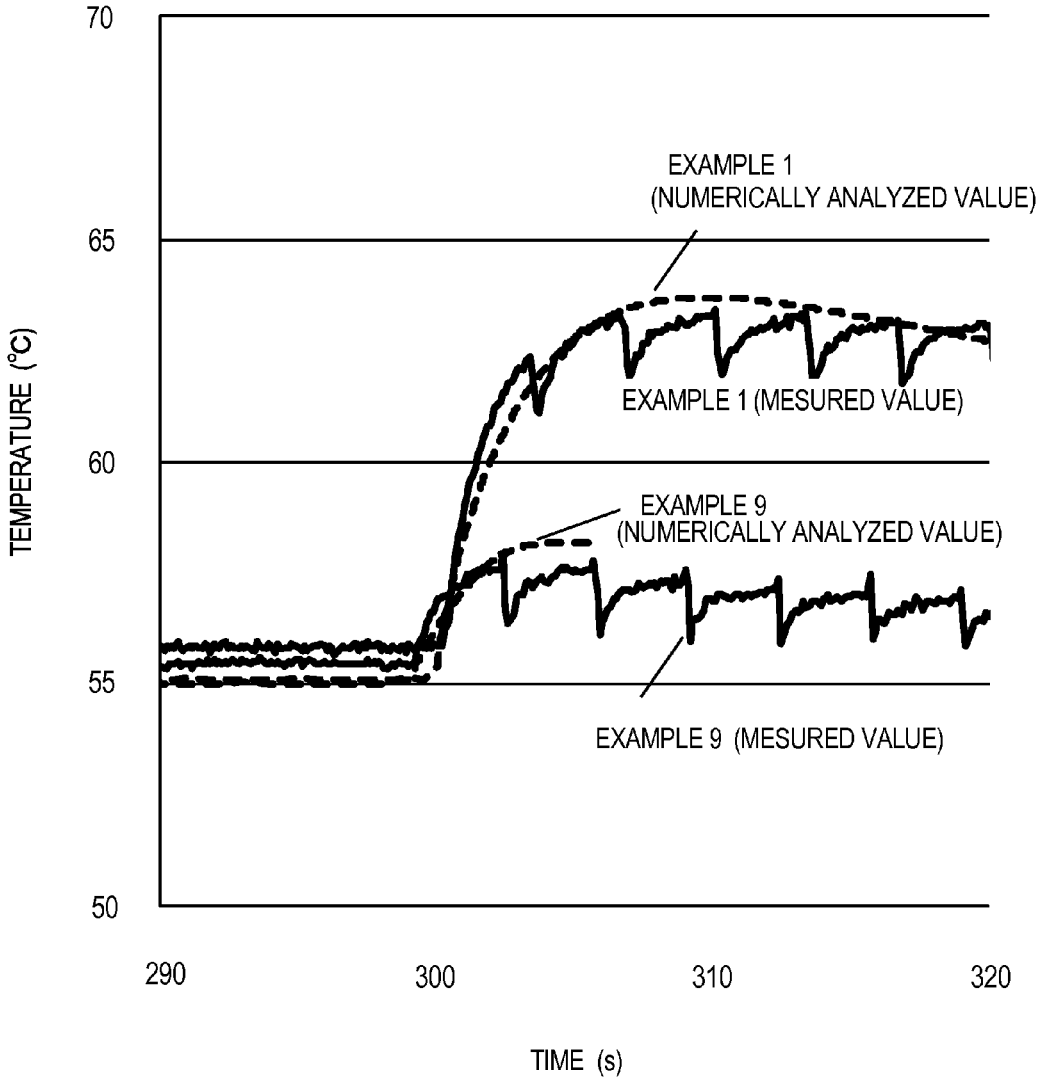
FIG. 12 is a graph showing a change in temperature of the recording element substrate with time in Examples 1 and 9 of the present invention.
Figure 13A:
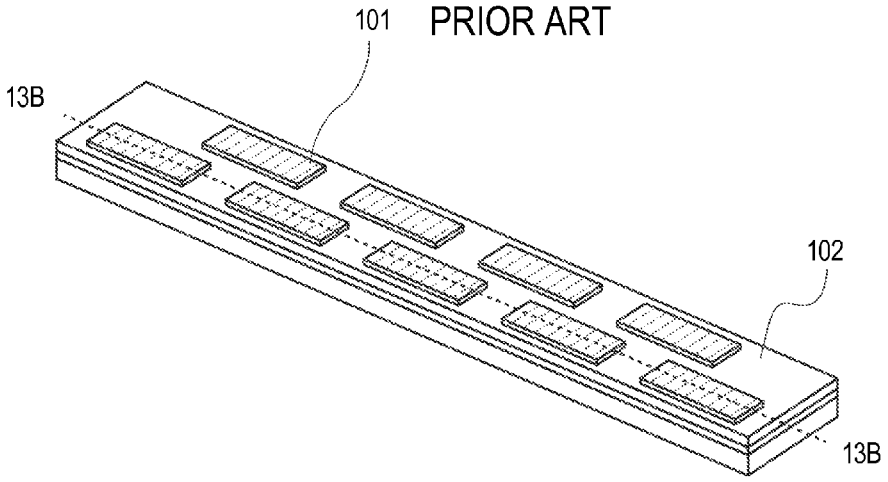
FIG. 13A PRIOR ART
FIG. 13A is a schematic view illustrating a structure of a conventional liquid ejection head.
Figure 13B:
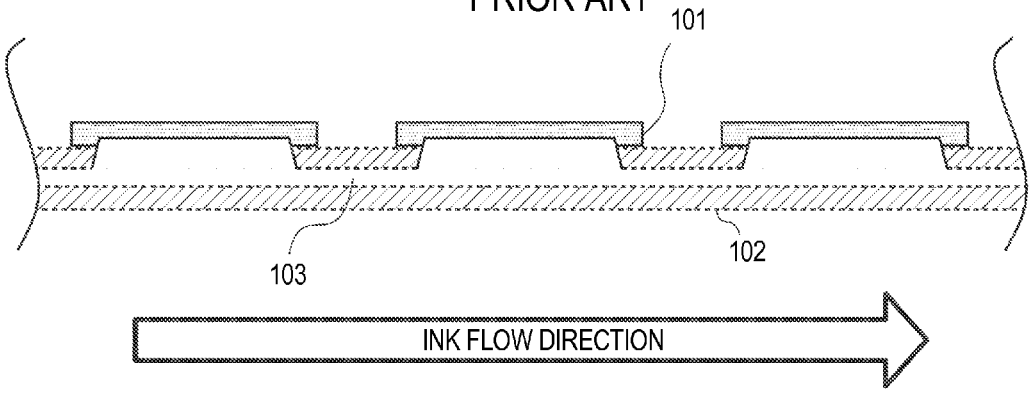
FIG. 13B PRIOR ART
FIG. 13B is a sectional view illustrating the structure of the conventional liquid ejection head.

A liquid ejection head was produced with the same dimension and configuration as those of Example 1 except that the shape of the insulation member 4 was set to that illustrated in FIGS. 10A and 10B. A change in temperature of the recording element substrate 1 with time was measured in the case of controlling the temperature of each recording element substrate to 55° C. by a sub-heater during printing standby, and driving the head under the condition shown in Table 1 after holding each recording element substrate 1 for 300 seconds to resume printing. FIG. 12 shows the change in temperature together with numerically analyzed calculated values. In the numerical analysis, an analysis condition is set so that natural convection is reproduced, considering a variation in gravity and density with temperature. Measured values of Examples 1 and 9 each exhibit a profile in which the temperature falls rapidly at a predetermined period. The reason for this is that the same image of 4"×6" is printed repeatedly and printing is suspended in a margin portion between images during measurement. In the numerical analysis, calculation is performed under the condition that printing is continued without providing suspension time. Therefore, the condition is different from that during measurement in a strict sense. However, as is understood from FIG. 12, the calculated value obtained by the numerical analysis is well matched with the measured value.

In Example 9, the width of the individual liquid chamber 6 is set to be larger than that of Example 1, and hence, convection occurs in the individual liquid chamber 6 during temperature controlled standby, and a rise in temperature of the ink is suppressed. On the other hand, in Example 1, the width of the individual liquid chamber 6 is small, and convection does not occur easily, and hence the ink raises its temperature in the individual liquid chamber 6. Therefore, in Example 1, a transient rise in temperature occurs during resumption of printing. In contrast, in Example 9, it is understood that the amount of a rise in temperature is suppressed greatly. Therefore, a temperature difference is small among multiple printed images, and the quality of images is maintained to be more uniform.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-136866, filed Jun. 18, 2012 and No. 2013-079508, filed Apr. 5, 2013 which are hereby incorporated by reference herein in their entirety.

The invention claimed is:

1. A liquid ejection head, comprising:

a first support member including a flow path for supplying liquid and an opening communicating with the flow path;

at least one second support member including an individual liquid chamber communicating with the opening, the at least one second support member being arranged on the first support member along the flow path; and a recording element substrate including an energy-generating element for generating energy to be used for ejecting the liquid, and a supply port for supplying the liquid to the energy-generating element, the supply port communicating with the individual liquid chamber, the recording element substrate being supported by a back surface of the at least one second support member with respect to an opposite surface thereof facing the first support member, wherein when energy to be input per ejection liquid droplet volume in the energy-generating element is defined as P (μJ/pL), a thermal resistance R (K/W) of a shortest heat transfer path of the at least one second support member between the recording element substrate and the first support member satisfies the following expression:

$$R \geq 1.4/\ln\{0.525e^{1.004P}-0.372\}^{-1}.$$

2. A liquid ejection head according to claim 1, wherein the first support member comprises an inflow port for allowing the liquid to flow into the flow path and an outflow port for allowing the liquid to flow out from the flow path, and the liquid having flown out from the outflow port flows into the inflow port through a circulation path provided outside of the liquid ejection head.

3. A liquid ejection head according to claim 1, wherein a plurality of the second support members are arranged in a longer direction of the first support member.

4. A liquid ejection head according to claim 1, wherein the flow path extends so as to meander in a longer direction of the first support member.

5. A liquid ejection head according to claim 1, wherein, when the energy-generating element is driven at a drive frequency of 1.8 kHz or less, a ratio Q/Q' between ejection energy per unit time Q to be applied from the energy-generating element to the liquid and a heat discharge per unit time Q' to be transferred from the energy-generating element as a generation source to the first support member is 5.1 or more.

6. A liquid ejection head according to claim 2, wherein a heat discharge per unit time Q' to be transferred from the energy-generating element as a generation source to the first support member during driving under maximum load regarding all the recording element substrates is determined by the following expression:

$$Q' = \frac{(\Delta Vd / Vd) \cdot Cp}{(C/100) \cdot \sum_{n=1}^{N} (F + f(N-n+1))^{-1}}$$

where Vd represents an ejection amount per ejection operation from one ejection orifice (ng);

C represents a temperature coefficient of Vd (%/K);

ΔVd represents a deviation of Vd causing visually recognizable unevenness (ng);

Cp represents a specific heat of the liquid (W/g/K);

F represents a flow rate of the liquid at an exit of the flow path (g/s);

f represents an ejection amount per recording element substrate during driving under maximum load (g/s); and N represents a total number of the recording element substrates.

7. A liquid ejection head according to claim 1, wherein the thermal resistance R of the at least one second support member in both end portions of the liquid ejection head in a longer direction of the liquid ejection head is larger than the thermal resistance R of the at least one second support member in a center portion of the liquid ejection head in the longer direction of the liquid ejection head.

8. A liquid ejection head according to claim 1, wherein the at least one second support member contains a space portion partitioned from the individual liquid chamber.

9. A liquid ejection head according to claim 1, wherein the individual liquid chamber provided in the at least one second support member has a width of 3 mm or more in an array direction in which ejection orifices for ejecting the liquid are arranged.

10. A liquid ejection head according to claim 1, wherein the individual liquid chamber provided in the at least one second support member has a width of 3 mm or more in a paper conveyance direction.

11. A liquid ejection head according to claim 1, further comprising a terminal support positioned adjacent to the at least one second support member on the first support member, wherein the terminal support supports a lead terminal electrically connected to a signal input electrode of the recording element substrate and has a modulus of elasticity higher than a modulus of elasticity of the at least one second support member.

12. A liquid ejection apparatus, comprising:

the liquid ejection head according to claim 1; and a cooler for cooling the liquid supplied to the flow path.

13. A liquid ejection head, comprising:

a first support member including a flow path for supplying liquid and multiple openings communicating with the flow path;

at least one second support member arranged on the first support member; and multiple recording element substrates each including an energy-generating element for generating energy to be used for ejecting the liquid, the multiple recording element substrates being arranged on a back surface of the at least one second support member with respect to a surface thereof on which the first support member is arranged, wherein when energy to be input per ejection liquid droplet volume in the energy-generating element is defined as P (μJ/pL), a thermal resistance R (K/W) of a shortest heat transfer path of the at least one second support member between each of the multiple recording element substrates and the first support member satisfies the following expression:

$$R \geq 1.4/\ln\{0.525e^{1.004P}-0.372\}^{-1}.$$

14. A liquid ejection head according to claim 13, wherein the first support member comprises an inflow port for allowing the liquid to flow into the flow path and an outflow port for allowing the liquid to flow out from the flow path, and the liquid having flown out from the outflow port flows into the inflow port through a circulation path provided outside of the liquid ejection head.

15. A liquid ejection head according to claim 13, wherein, when the energy-generating element is driven at a drive frequency of 1.8 kHz or less, a ratio Q/Q' between ejection energy per unit time Q to be applied from the energy-generating element to the liquid and a heat discharge per unit time Q' to be transferred from the energy-generating element as a generation source to the first support member is 5.1 or more.

16. A liquid ejection head according to claim 13, wherein the thermal resistance R of the at least one second support member in both end portions of the liquid ejection head in a longer direction of the liquid ejection head is larger than the thermal resistance R of the at least one second support member in a center portion of the liquid ejection head in the longer direction of the liquid ejection head.

* * * * *